US006702612B2

(12) United States Patent
Miyazaki et al.

(10) Patent No.: US 6,702,612 B2
(45) Date of Patent: Mar. 9, 2004

(54) TERMINAL CONNECTING DEVICE

(75) Inventors: Sho Miyazaki, Nagoya (JP); Kei Sasaki, Toyota (JP); Hiroshi Aihara, Toyota (JP)

(73) Assignees: Autonetworks Technologies, Ltd., Nagoya (JP); Sumitomo Wiring Systems, Ltd., Mie (JP); Sumitomo Electric Industries, Ltd., Osaka (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/092,564

(22) Filed: Mar. 8, 2002

(65) Prior Publication Data

US 2002/0132522 A1 Sep. 19, 2002

(30) Foreign Application Priority Data

Mar. 13, 2001 (JP) ..... 2001-070923

(51) Int. Cl.[7] ..... H01R 13/73
(52) U.S. Cl. ..... 439/559
(58) Field of Search ..... 439/559, 556, 439/587, 908

(56) References Cited

U.S. PATENT DOCUMENTS 1,697,814 A * 1/1929 Forbes ..... 439/559
2,705,308 A * 3/1955 Howard ..... 439/556
2,976,512 A * 3/1961 Vallee ..... 439/556
3,388,368 A 6/1968 Sauber
3,495,028 A * 2/1970 Tutthill ..... 439/559
4,743,210 A 5/1988 Schild et al.
4,851,725 A 7/1989 Keck
6,220,901 B1 4/2001 Fisher et al.
6,464,538 B2 10/2002 Miyazaki et al.

FOREIGN PATENT DOCUMENTS

GB 921284 * 3/1963 ..... 439/559
JP 11-098755 A 4/1999

* cited by examiner

*Primary Examiner*—Gary Paumen
(74) *Attorney, Agent, or Firm*—Oliff & Berridge, PLC

(57) ABSTRACT

A bus bar to be inserted in a circular through hole provided in a casing and connecting terminals provided inside and outside the casing has a circular section in a portion passing through the through hole. The outer periphery of the circular section is covered with a grommet having a circular section, and the ratios of the grommet in vertical and transverse directions are equal to each other. Accordingly, when a bus bar body including the bus bar and the grommet is fitted in the through hole, the grommet has compression ratios equal to each other in the vertical and transverse directions. Consequently, the fitting portions of the bus bar and the grommet uniformly come in close contact with each other, and a sealing property can be fully maintained in the fitting portions of the grommet and the bus bar.

9 Claims, 12 Drawing Sheets

TERMINAL CONNECTING DEVICE

BACKGROUND OF THE INVENTION

1. Industrial Field of Application

The present invention relates to a terminal connecting device.

2. Related Art

In a controller for controlling a motor of an electric vehicle, for example, a controller body is covered with a case and is thus protected. In order to connect the controller body to the motor, accordingly, it is necessary to lead out a terminal of the controller body to the outside of the case. The Unexamined Japanese Patent Application Publication No. Hei11-26050 has described an example of connection to be employed in that case.

As shown in FIG. 13, a flat conductor bent like an L-shape is used for a bus bar 1, a through hole 3A provided in a case 3 is caused to penetrate through a grommet 2 formed of an insulating material and the grommet 2 is fixed to the case 3 with a screw 7.

On the other hand, a terminal 5 of the bus bar and a terminal 4 on the controller side are fixed to each other with a bolt 6 in the case 3, and the other terminal of the bus bar which is not shown is lead out through the through hole of the case 3.

In this case, it is necessary to maintain insulating and sealing properties between the case 3 and the bus bar 1. Therefore, the grommet 2 formed of an insulating material is fitted in the through hole 3A of the case 3 by pressure.

SUMMARY OF THE INVENTION

Problems that the Invention is to Solve

According to such a structure, the sealing property should be improved between an opening 2A of the grommet 2 and the bus bar 1. More specifically, the flat conductor is used for the bus bar 1. Therefore, the ratios in vertical and transverse directions of the bus bar 1 are different from each other. Accordingly, when the grommet 2 (circular section) is fitted in the through hole 3A (circular) of a case 3, the fitting portions of the bus bar 1 and the grommet 2 do not uniformly come in close contact with each other because the grommet 2 has the compression ratios in the vertical and transverse direction which are different from each other. Thus, there is a fear for the sealing property.

The invention has been completed based on such circumstances and has an object to provide a terminal connecting device having a high sealing property.

In order to achieve the object, a first aspect of the invention is directed to a terminal connecting device for connecting both outer and inner terminals provided outside and inside a casing through a conductive bus bar inserted into a circular through hole opened on a wall surface of the casing, wherein a portion of the bus bar which passes through the through hole has a circular section, a hole wall of the through hole is attached, by pressure, to an outer periphery of the portion having the circular section, and a grommet formed of an insulating material which is to be sealed along a whole periphery of the hole wall is fitted and attached.

A second aspect of the invention is directed to the terminal connecting device according to the first aspect of the invention, wherein the bus bar is formed of a round bar member and an end side to be connected to the outer and inner terminals is provided with a terminal connecting portion crushed like a flat plate.

A third aspect of the invention is directed to the terminal connecting device according to the first or second aspect of the invention, wherein a contact portion is formed along a whole outer peripheral surface of the grommet, and when the bus bar provided with the grommet is to be inserted into the through hole, the contact portion is attached by pressure with being sealed to a hole wall of the through hole to attach a whole bus bar.

Function and Effect of the Invention

Invention of Claim 1

According to the first aspect of the invention, the bus bar to be inserted in the circular through hole provided in the casing has a circular section in the portion passing through the through hole. The grommet having the circular section is fitted and attached into the outer periphery of the portion having the circular section and the ratios in the vertical and transverse directions of the grommet are equal to each other. Accordingly, when the whole bus bar including the bus bar and the grommet is fitted in the through hole and is attached by pressure, the compression ratios of the grommet are equal to each other over the whole periphery. Consequently, the fitting portions of the external wall of the bus bar and the inner peripheral surface of the grommet and the fitting portions of the hole wall of the through hole and the outer peripheral surface of the grommet uniformly come in contact with each other. Consequently, a sealing property can be maintained along the whole periphery of the through hole of the casing.

Conventionally, a base material formed of a flat plate is used for the bus bar. Consequently, if the connecting portion of the terminals is to be constituted on both ends and they are to be set into positions twisted by 90 degrees, at least one of them should be formed by bending a predetermined expanded shape. In this case, a great deal of labor and time are required for the processing and yield is also deteriorated.

In this respect, according to the second aspect of the invention, the bus bar is formed of a round bar member. Therefore, the connecting terminal portions formed on both ends can be crushed by pressure in a free direction, and they can also be set easily in the twisted positions and the yield can also be enhanced.

Conventionally, the bus bar body including the bus bar and the grommet and the casing are fixed with a screw. According to the third aspect of the invention, however, a contact portion is formed along a whole outer peripheral surface of the grommet, and when the bus bar provided with the grommet is to be inserted into the through hole, the contact portion is attached by pressure with being sealed to a hole wall of the through hole to attach a whole bus bar without slip-off.

Accordingly, the screw for fixing is not required so that the number of parts can be reduced and an excellent assembling property can also be obtained.

DETAILED DESCRIPTION OF THE PREFERRED EMBODIMENTS

Preferred embodiments of the invention will be described below with reference to the accompanying drawings.

First Embodiment

A first embodiment of the invention will be described with reference to FIGS. 1 to 12.

Figure 5:
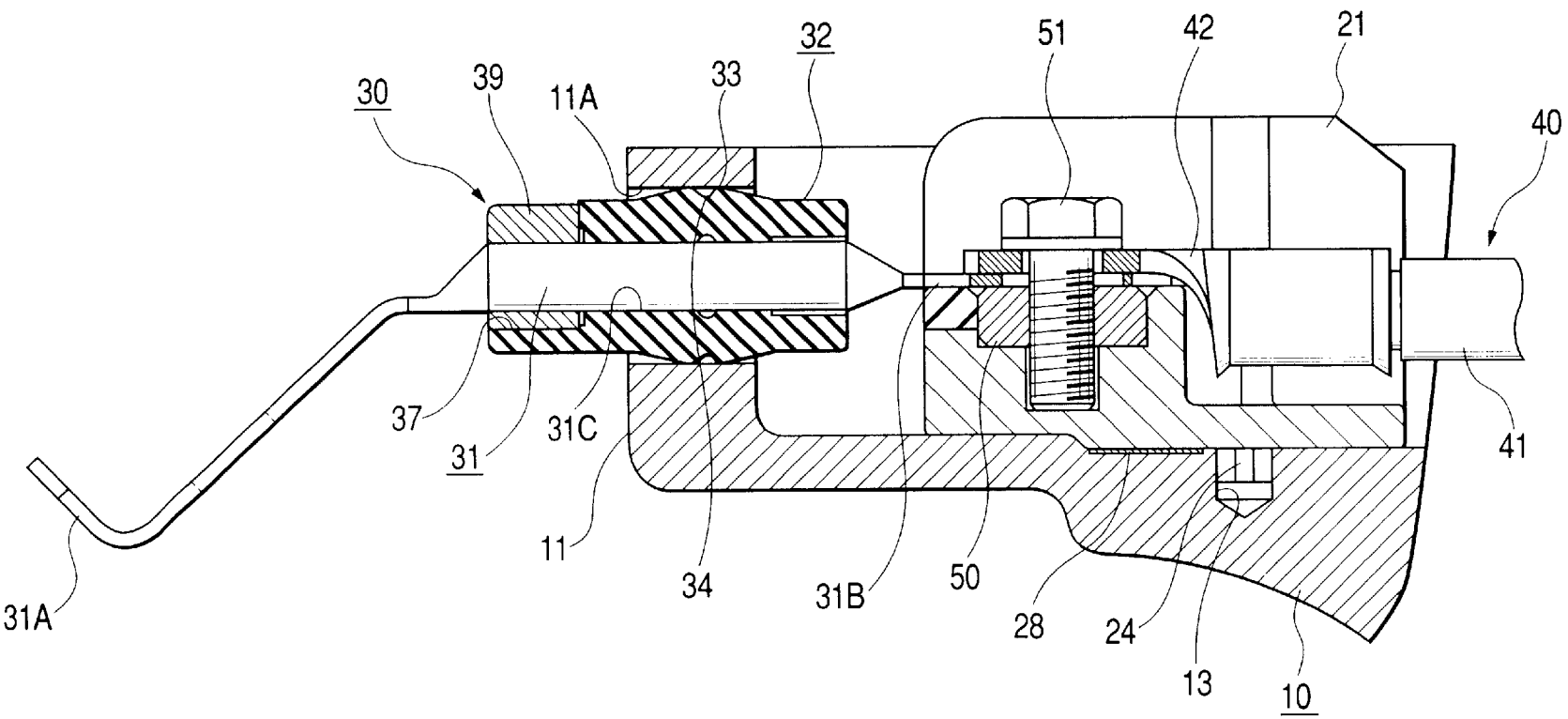
FIG. 5 is a longitudinal sectional view showing the periphery of the bus bar according to the first embodiment (after the bus bar is attached)
Figure 6:
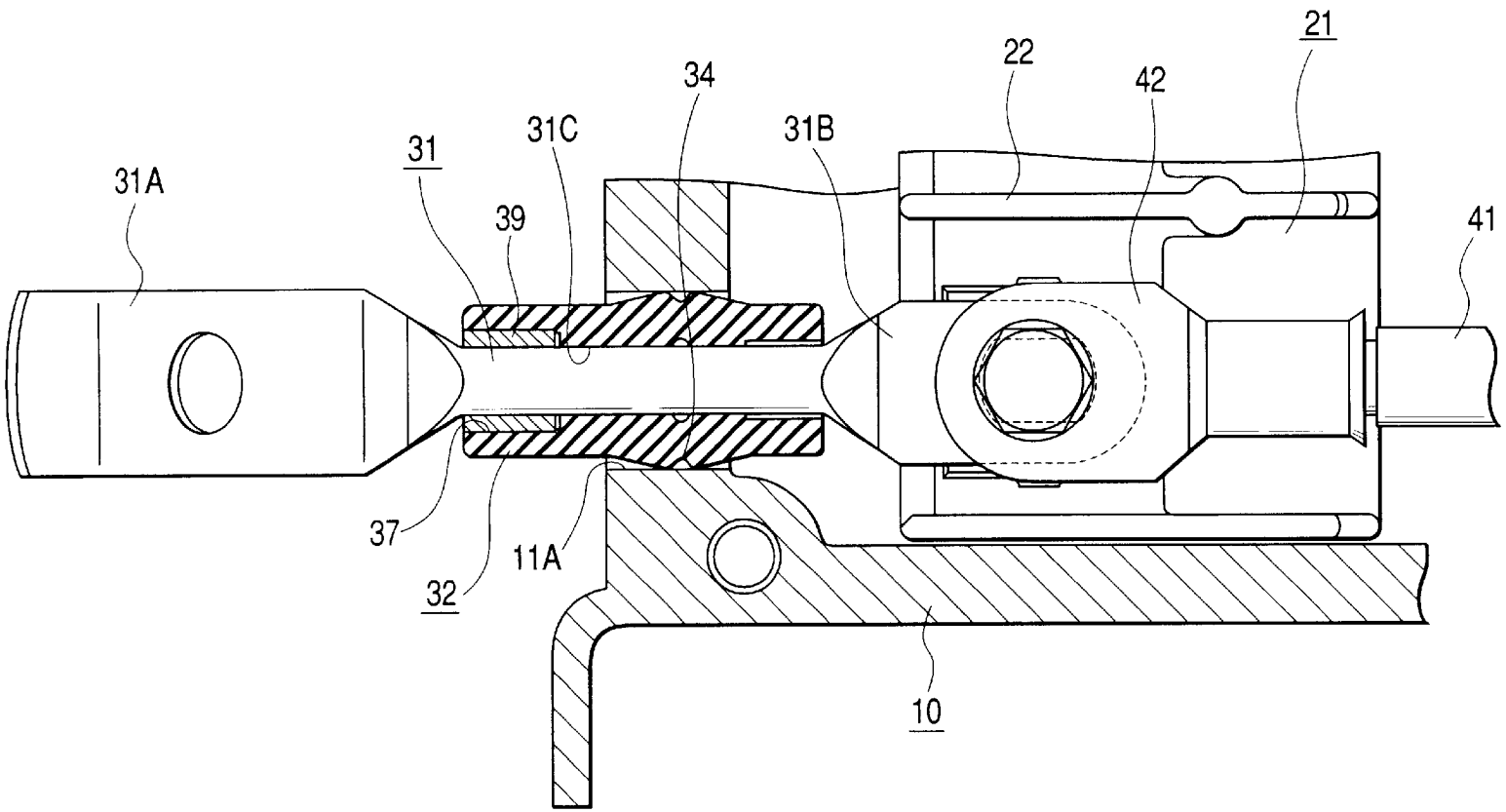
FIG. 6 is a cross-sectional view showing the periphery of the bus bar according to the first embodiment (after the bus bar is attached)
Figure 7:
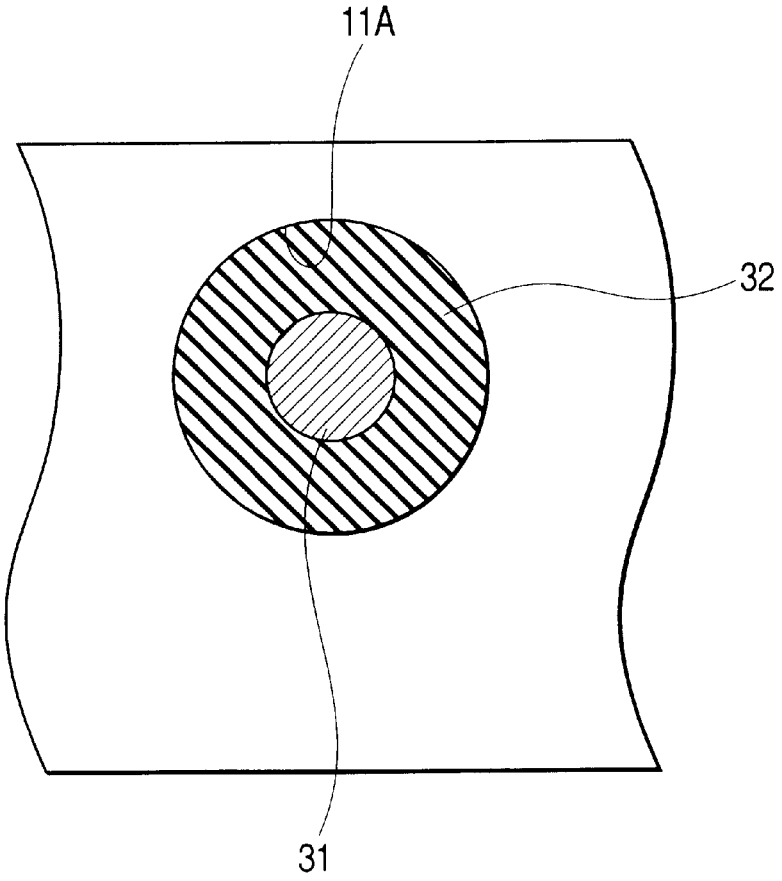
FIG. 7 is a sectional view showing a maximum diameter portion of the bus bar according to the first embodiment (after the bus bar is attached)
Figure 8:
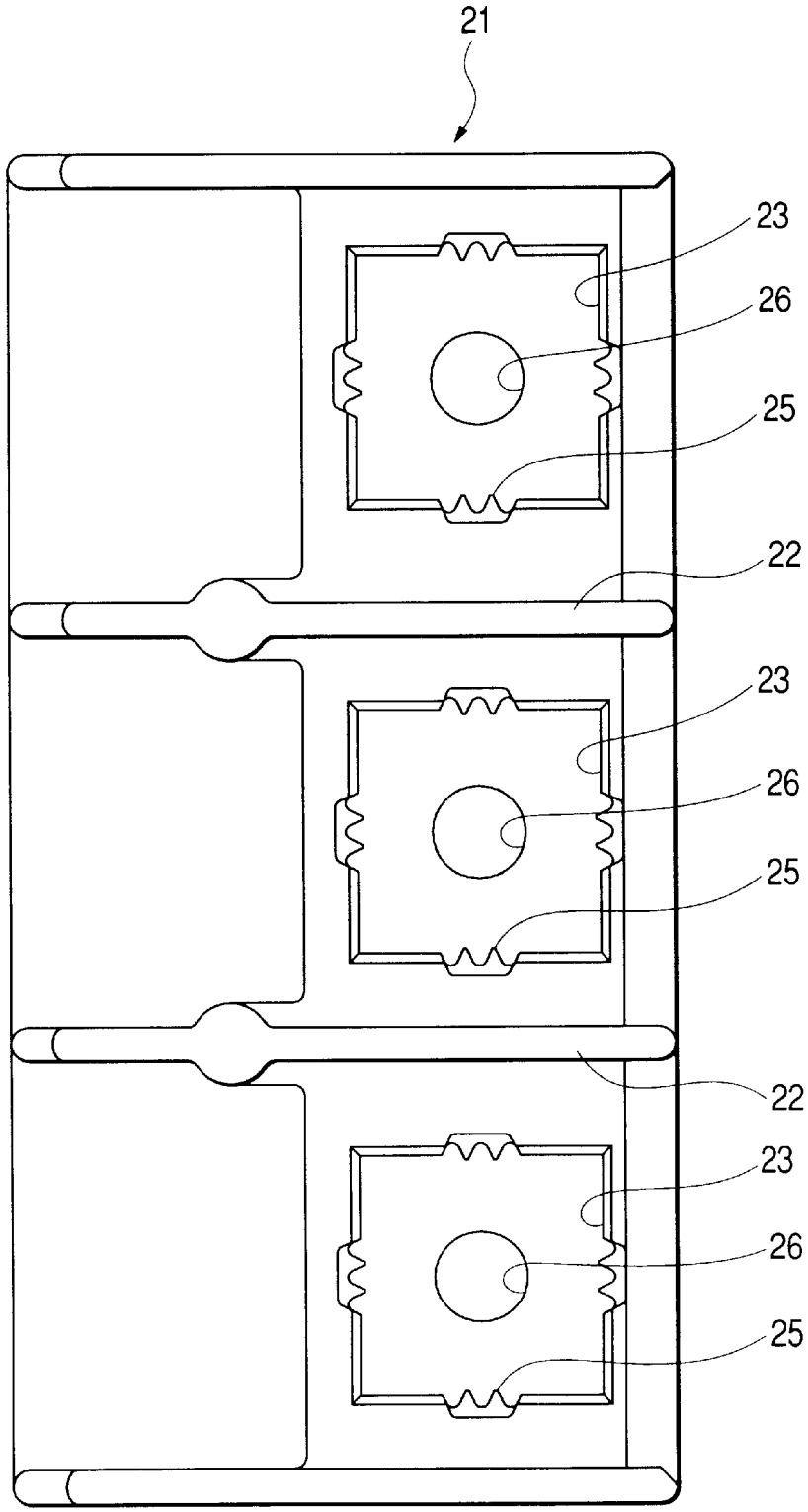
FIG. 8 is a top view showing a single terminal base according to the first embodiment.
Figure 9:
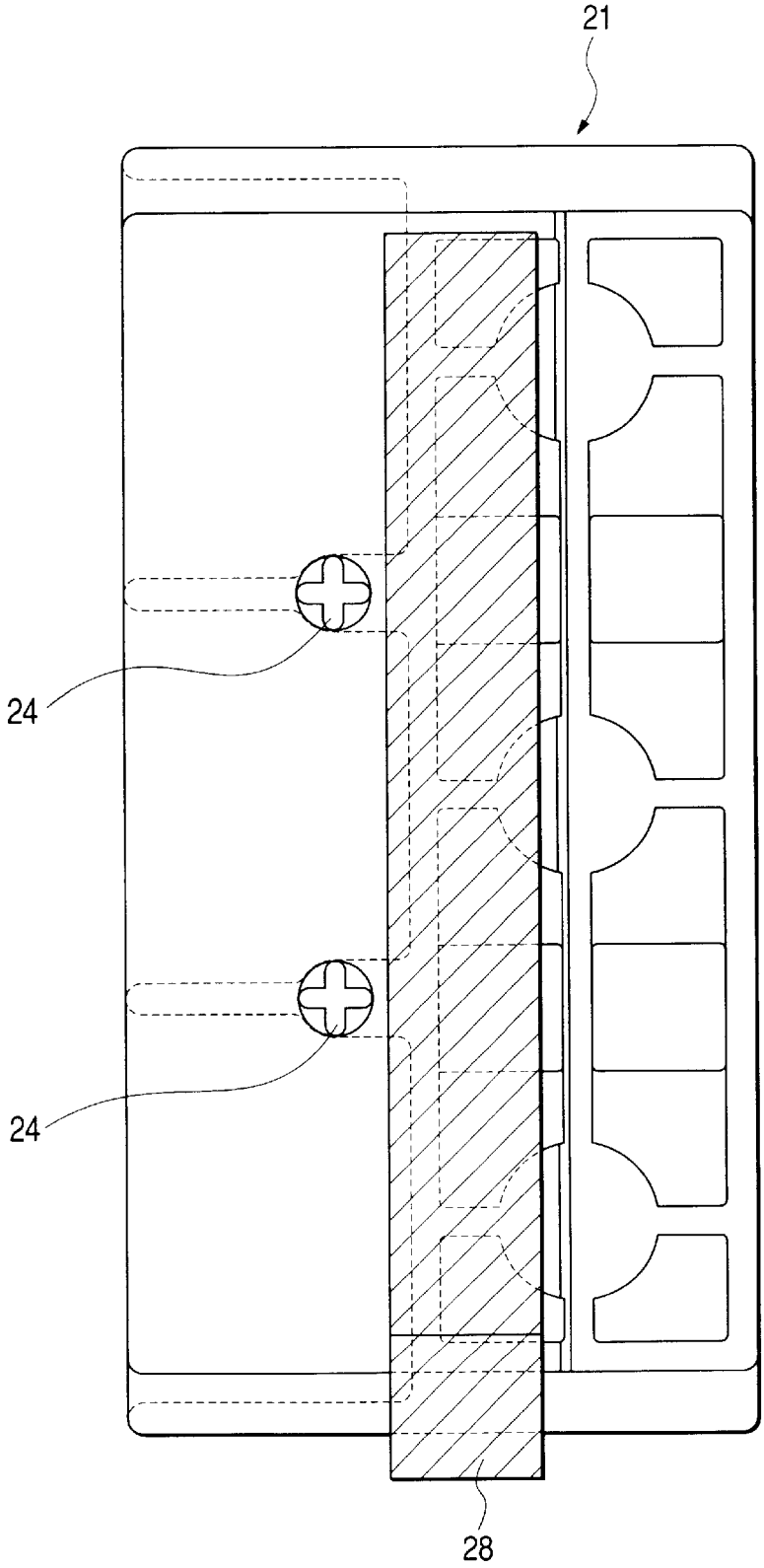
FIG. 9 is a rear view showing the single terminal base according to the first embodiment.
Figure 10:
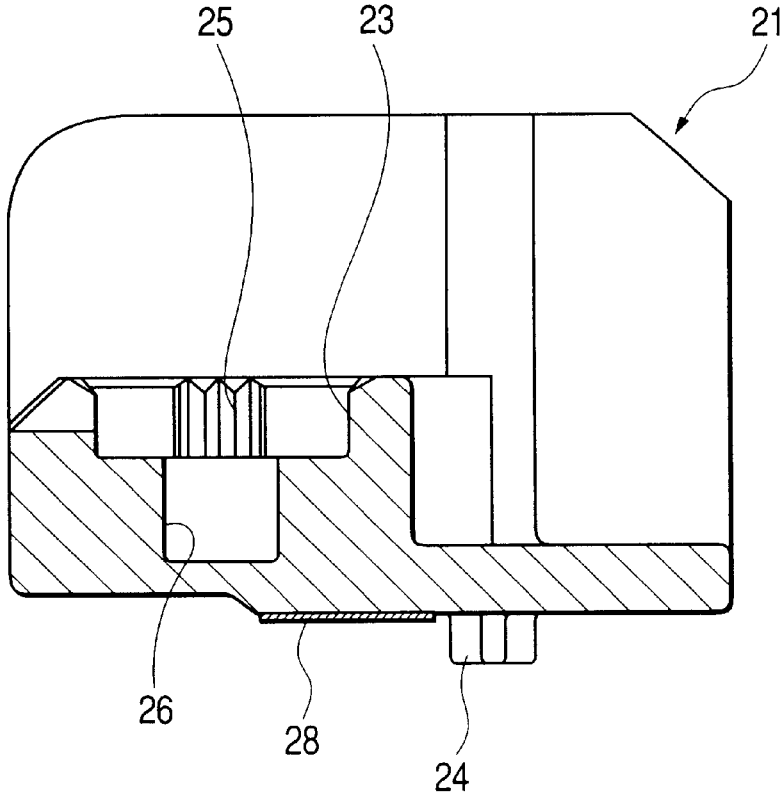
FIG. 10 is a sectional view showing the single terminal base according to the first embodiment.
Figure 11:
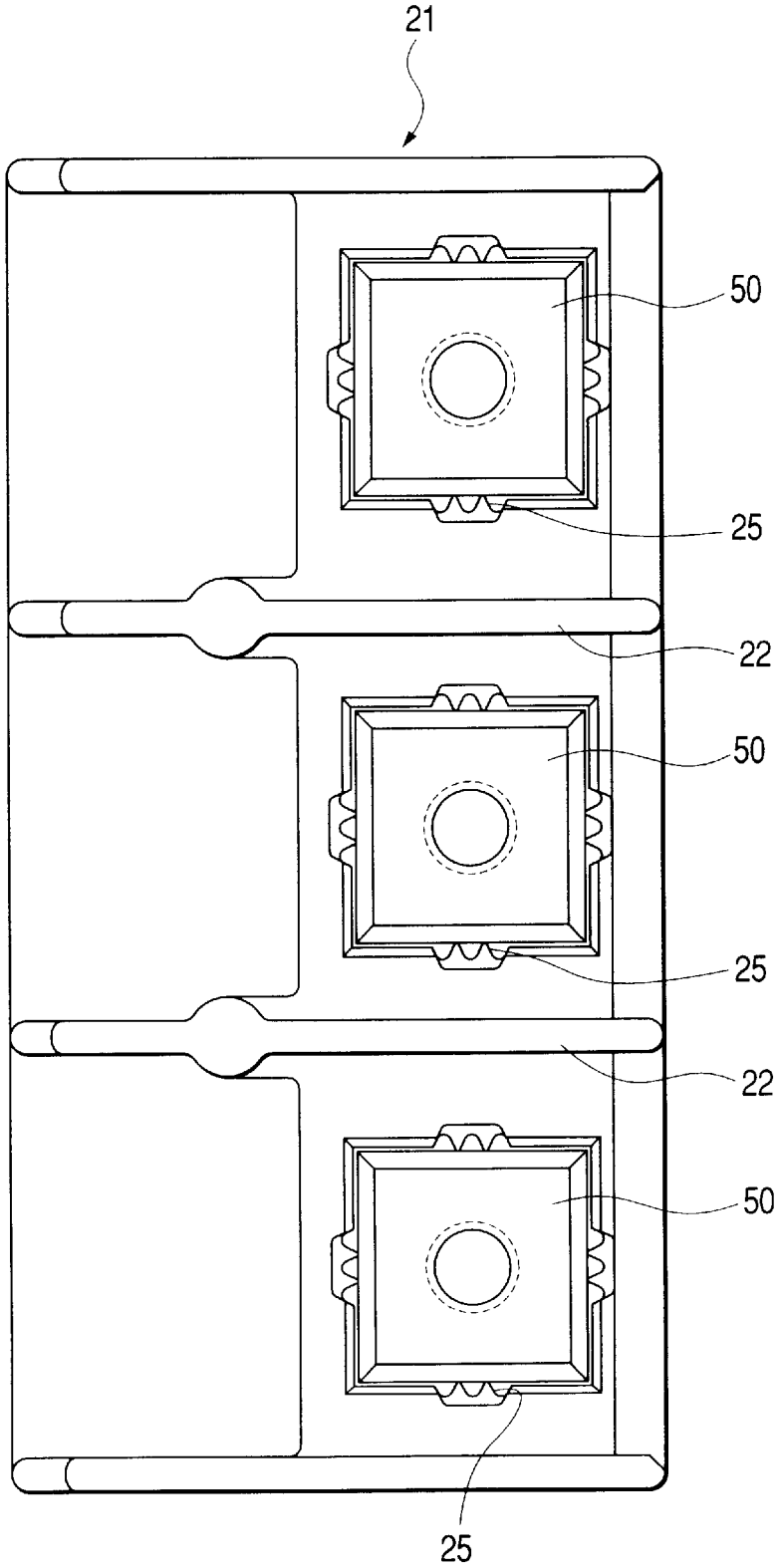
FIG. 11 is a top view showing the terminal base in a nut attachment state according to the first embodiment.
Figure 12:
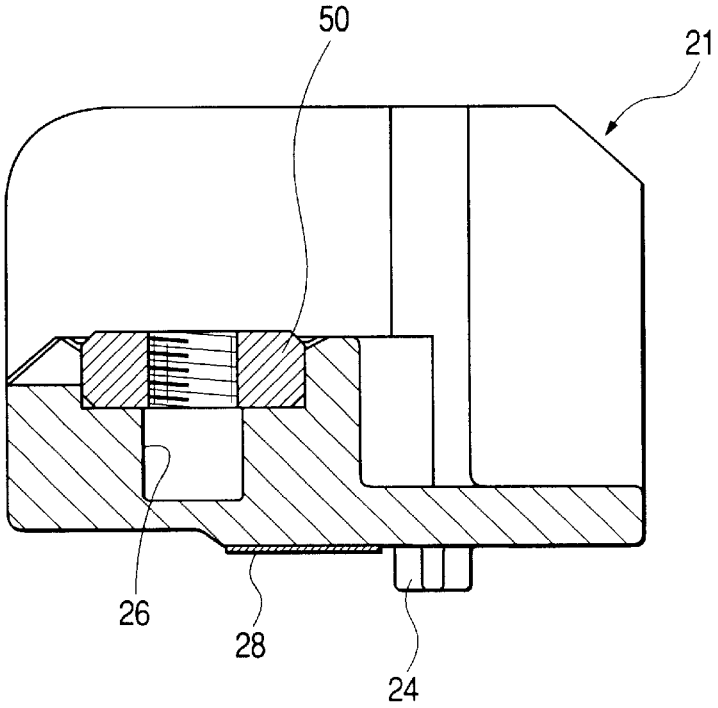
FIG. 12 is a sectional view showing the terminal base in a nut attachment state according to the first embodiment.
Figure 13:
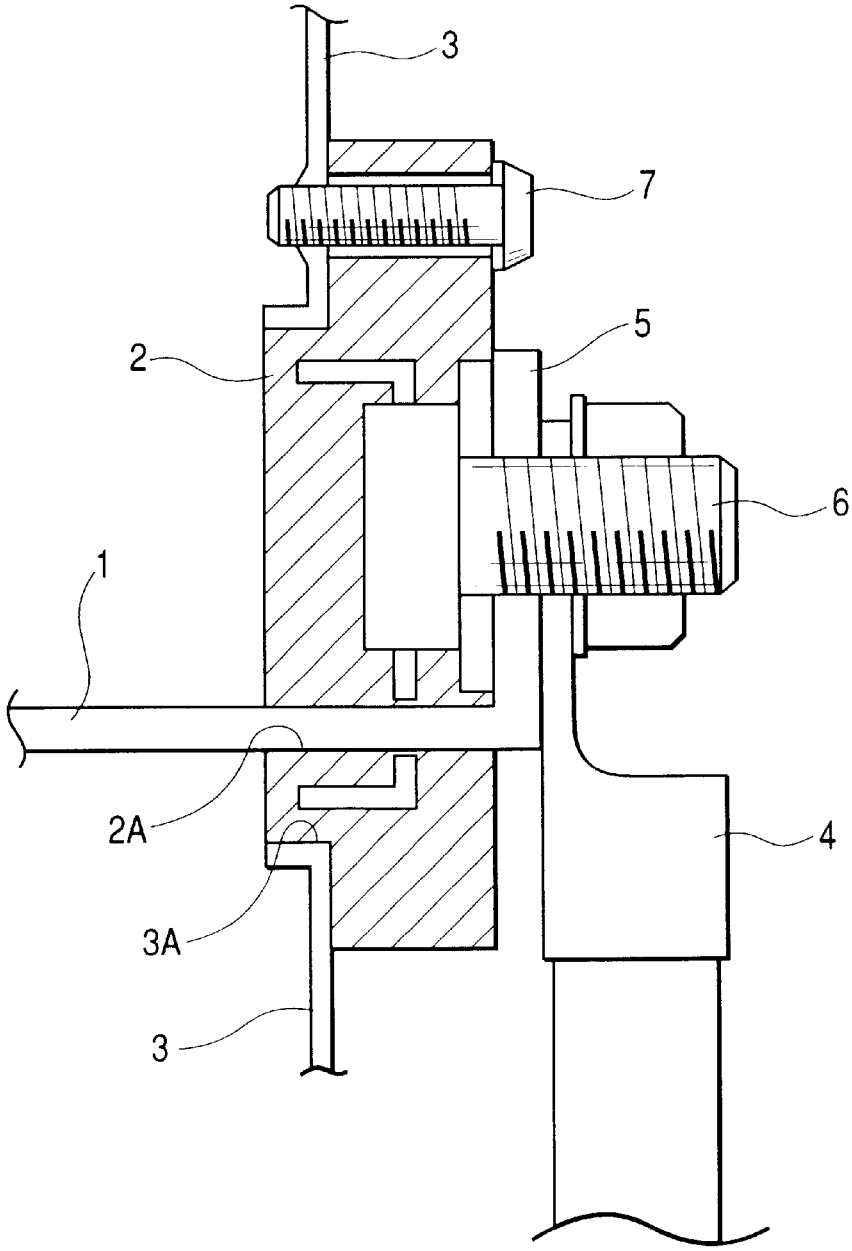
FIG. 13 is a sectional view showing a conventional embodiment.

A terminal connecting device according to the first embodiment is applied to a driving motor for an electric vehicle. The reference numeral 10 denotes a joint case which is formed of metal and has an almost box shape, for example. A terminal base 21 is attached into the joint case 10, and as shown in FIG. 5, is positioned by a concave portion 13 provided on the bottom face of the joint case 10 and a fitting projection 24 provided on the bottom face of the terminal base 21 and is fixed with a double coated adhesive tape 28 stuck to the bottom face portion of the terminal base 21. The terminal base 21 thus fixed is divided into three chambers through a partition board 22. Each chamber is provided with a nut housing chamber 23 having a rectangular shape. As shown in FIG. 8, a nut 50 for fixing a connecting terminal is attached to the nut housing chamber 23. For the positioning, a two-bar positioning piece 25 is protruded inwards in a vertical direction on each side wall of the nut housing chamber 23. An escape hole 26 is provided on the bottom face of the nut housing chamber 23, and a bolt 51 screwed to the nut 50 is escaped.

Three circular through holes 11A are formed on a front wall 11 of the joint case 10 in a transverse direction corresponding to the chambers partitioned by the partition board 22 on the terminal base 21. On the other hand, three electric wire inserting holes 11C for inserting a shielding electric wire are formed on a surface opposite to the through hole 11A in the joint case 10.

By utilizing each through hole 11A, three bus bars 31 are attached.

Figure 1:
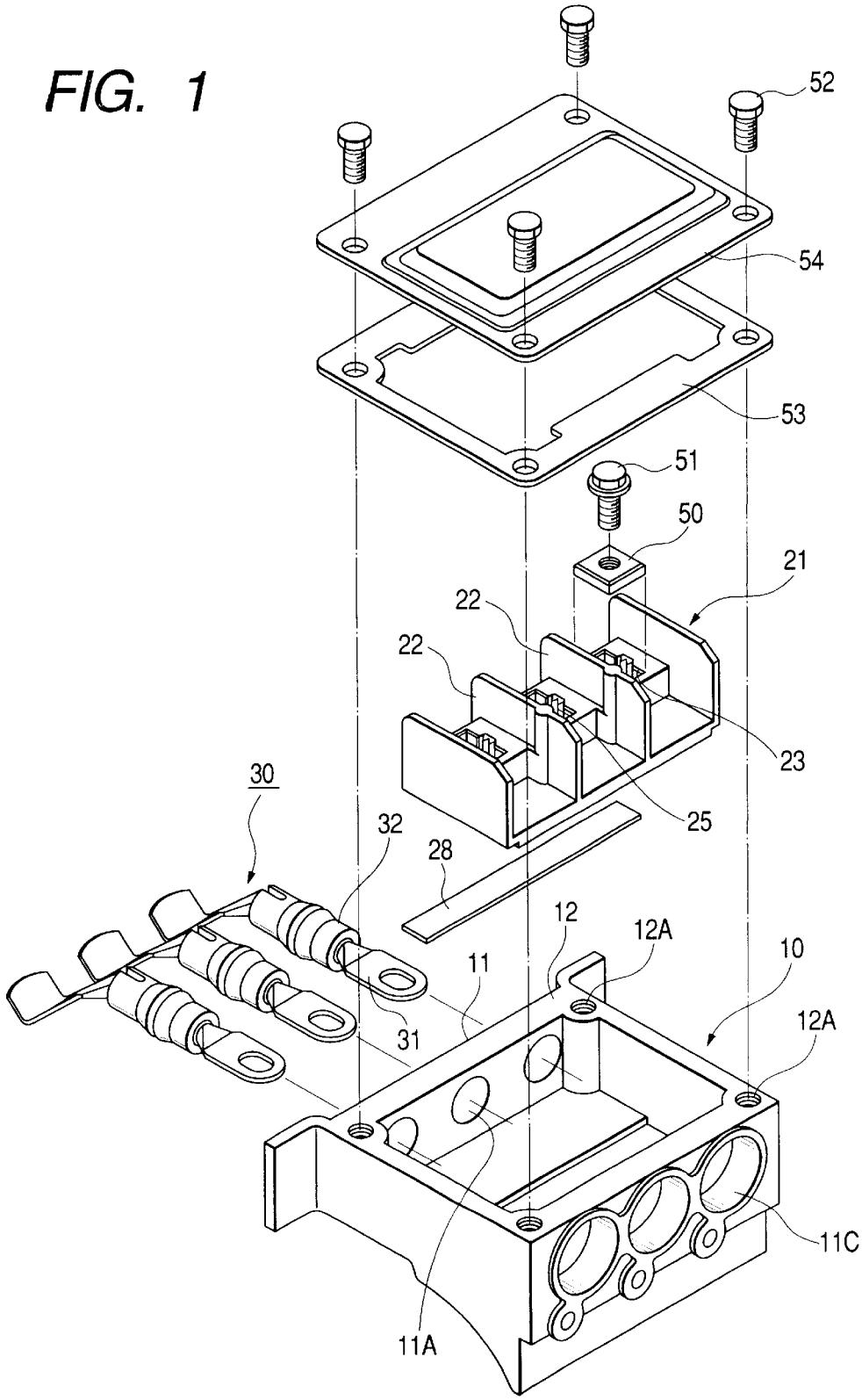
FIG. 1 is an exploded perspective view showing a part of a first embodiment.
Figure 2:
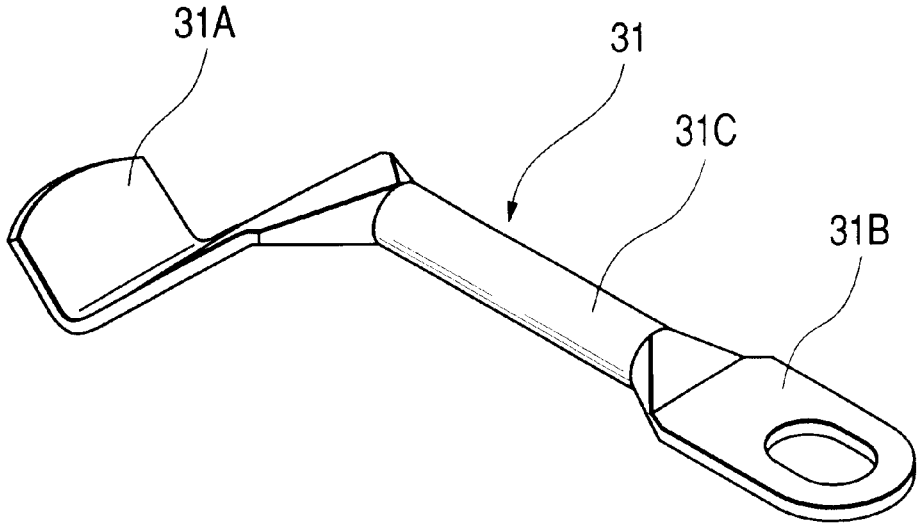
FIG. 2 is a perspective view showing a single bus bar according to the first embodiment.

As shown in FIG. 2, the bus bar 31 is formed of a round bar member and terminal connecting portions 31A and 31B obtained by crushing the round bar member like a flat plate are formed on both end sides thereof.

The terminal connecting portion 31A is connected to a stator terminal of a motor which is not shown and the terminal connecting portion 31B is connected to a terminal fixture 42 attached to an end of the shielding electric wire 41.

The joint case 10 is provided in a motor casing which is not shown. At this time, the terminal connecting portion 31A provided on one of ends of the bus bar 31 is plunged into the motor casing and is exposed to oil in the casing.

A grommet 32 for insulating an adjacent apparatus such as the joint case 10 from the bus bar 31 is fitted and attached into the outer periphery of the bus bar 31, and is formed of a rubber material having elasticity, for example. Thus, the bus bar body 30 according to the embodiment is constituted by the bus bar 31 and the grommet 32. In a processing procedure, both ends of the bus bar 31 is processed to form the terminal connecting portions 31A and 31B, and then, a grommet 32 is fitted and attached thereto.

Figure 3:
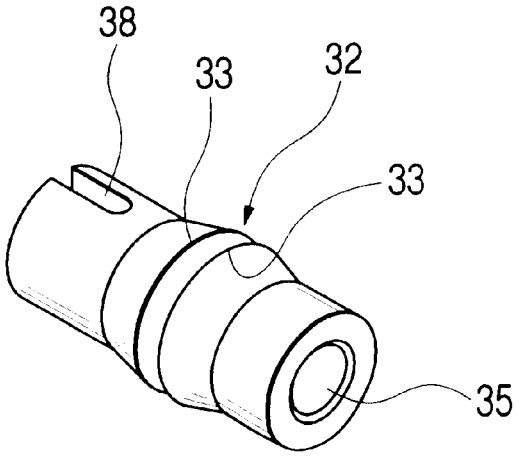
FIG. 3 is a perspective view showing a single grommet according to the first embodiment.
Figure 4:
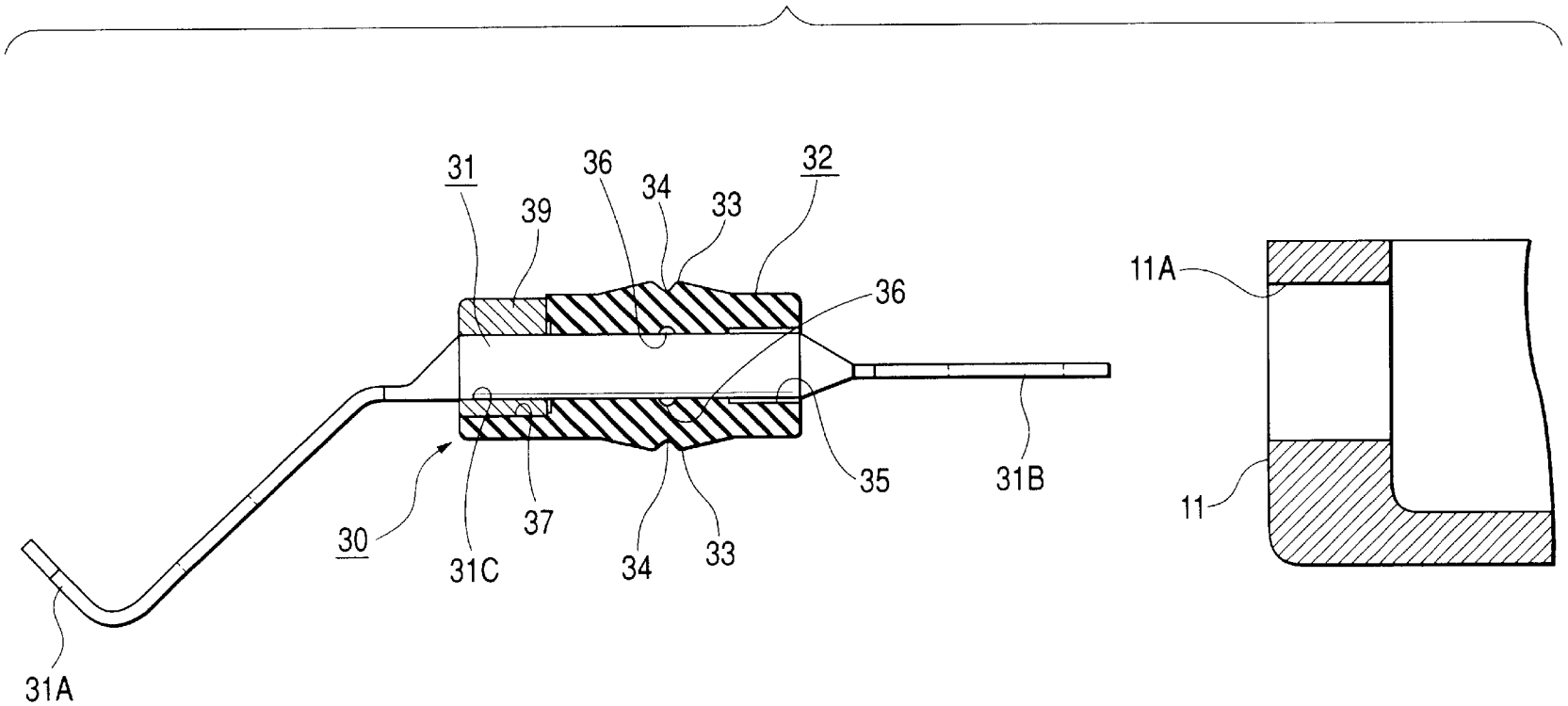
FIG. 4 is a longitudinal sectional view showing the periphery of the bus bar according to the first embodiment (before the bus bar is attached)

As shown in FIGS. 3 and 4, moreover, the grommet 32 has such an almost cylindrical shape as to insert the bus bar 31 therein, and a central portion thereof is formed to gradually increase a thickness from both sides toward the center. In other words, two angle portions 33 (maximum diameter portions) and one valley portion 34 are annularly provided over the whole surface in the vicinity of the central portion on the outer peripheral surface of the grommet.

By the way, since the outer diameter of the maximum diameter portion 33 of the grommet 32 is larger than the hole diameter of the through hole 11A, in condition that the whole bus bar body 30 is fitted by pressure without slip-off into a predetermined position to mount the whole bus bar body 30 to the joint case 10, owing that the maximum diameter portion 33 of the grommet 32 is attached by pressure onto the hole wall of the through hole 11A as shown in FIG. 5, the whole bus bar body 30 is fitted and attached.

Therefore, in this embodiment, the maximum diameter 33 provided on the outer peripheral surface of the grommet 32 functions as a contact portion which is attached by pressure onto the hole wall of the through hole 11A.

Further, when the bus bar body 30 is attached to the joint case 10, the terminal connecting portion 31B on one ends of the bus bar 31 is positioned on the nut 50 of the nut housing chamber 23 and is fastened to the terminal based 21 with a bolt 51 together with the terminal fixture 42 of the shielding electric wire 41.

As described above, since both maximum diameter portions 33 interposing the valley portion 34 in the grommet 32 therebetween is attached by pressure to the hole wall of the through hole 11A by elastic force, and therefore also functions as a sealing edge. At this time, a corresponding portion of a bus bar 31 to which the grommet 32 is fitted has a circular section. Therefore, the grommet 32 is uniformly compressed over the whole periphery.

Consequently, each contact portion of the grommet 32 uniformly comes in close contact with and is sealed against the hole wall of the through hole 11A and an external wall 31C of the bus bar.

As shown in FIG. 4, moreover, an axial hole 35 permitting the insertion of the bus bar 31 penetrates through the core of the grommet 32, and an annular slit 36 is formed like a concave over the whole periphery in a position corresponding to the valley portion 34. One end side (a left end side of FIG. 4) of the axial hole 35 comes in cloth contact with the outer peripheral surface 31C of the bus bar 31 over the whole periphery within a range of a predetermined length by using the slit 36 as a boundary, and the other end side thereof (a right end side of FIG. 4) is enlarged like a trumpet toward the open side. Consequently, a region which is not in contact with the outer peripheral surface 31C of the bus bar 31 is provided so that an insertion resistance generated by inserting the grommet 32 into the bus bar 31 can be reduced.

Besides, one end of the grommet 32 (the left of FIG. 4) is thinned to form a hollow portion 37 of a slit provided on the outer peripheral surface 31C of the bus bar 31. Further, an opening portion 38 is provided by lacking at the same end of the grommet 32 so that a thermosetting adhesive 39 is injected to the hollow portion 37 therefrom. The thermosetting adhesive 39 is injected to regulate a displacement along the axis of the grommet 32 with respect to the bus bar 31.

Finally, a cover 54 is put on the upper surface of the joint case 10 through a seal plate 53 formed of a cushion material, and four corners thereof are fastened and fixed with a bolt 52.

Next, the function and effect of the embodiment having the structure described above will be described specifically. In the case in which the shielding electric wire 41 side is to be connected to the motor side, the bus bar body 30 is inserted into the through hole 11A of the joint case 10 and the terminal connecting portion 31A of the bus bar 31 is connected to the stator terminal of the motor with a screw. Subsequently, the shielding electric wire 41 is inserted into the joint case 10 through the electric wire inserting hole 11C and the terminal fixture 42 connected to the end thereof is superposed on the other terminal connecting portion 31B of the bus bar and is fastened to the nut 50 of the terminal base 21 with the bolt 51 in that state. Consequently, the terminal fixture 42 and the terminal connecting portion 31B of the bus bar are fastened together.

By repeating the connecting work for the three bus bar bodies 30, a work for connecting the terminal to the motor is completed. Then, when the cover 54 is attached through the seal plate 53, the whole work is completed.

As described above,the maximum diameter portion 33 formed on the outer peripheral surface of the grommet 32 is larger than the through hole 11A of the joint case 10. Therefore, in a state in which the bus bar body 30 is assembled into the joint case 10, the maximum diameter portion 33 of the grommet 32 comes in close contact with the hole edge of the through hole 11A in a compression state. Since the portion of the bus bar 31 for inserting the grommet 32 has a circular section, the grommet 32 is uniformly compressed over the whole surface. Consequently, each contact portion of the grommet 32 with the hole wall of the through hole 11A and the external wall 31C of the bus bar uniformly comes in close contact over the whole periphery. Thus, a high sealing property can be obtained.

According to the embodiment, moreover, the bus bar 31 and the grommet 32 are adhered by the thermosetting adhesion 39. Thus, the bus bar body 30 is inserted to the through hole 11A in the press state to fit and attach the maximum diameter portion 33 of the grommet 32 to the hole wall of the through hole 11A with respect to the joint case 10, and slip-off can be effectively prevented without using a screw differently from the conventional art. Accordingly, complicated screwing is not required and the number of parts can also be reduced.

Other Embodiment

The invention is not restricted to the embodiment described above with reference to the drawings but the following embodiment is also included in the technical range of the invention, for example, and furthermore, various changes can be made without departing from the scope of the invention.

(1) While the grommet is fitted and attached into the bus bar after the terminal connecting portion of the bus bar is formed in the embodiment, the grommet may be previously fitted and attached into the bus bar and the terminal connecting portion of the bus bar is formed.

What is claimed is:

1. A terminal connecting device for connecting an outer terminal provided outside a casing with an inner terminal provided inside the casing through a conductive bus bar inserted through a circular through hole in a wall surface of said casing, the terminal connecting device comprising:

said bus bar having a circular section, at least one end of said bus bar being provided with a flat terminal connecting portion, a grommet formed of an insulating material, the grommet attached to the circular section and including two angle portions, a valley portion being formed between the two angle portions, and an annular slit formed over an inner periphery of said grommet in a position corresponding to said valley portion, wherein the grommet seals along a hole wall of the through hole by pressure.

2. The terminal connecting device according to claim 1, wherein a contact portion of said grommet is formed along an outer peripheral surface of said grommet, and when said bus bar provided with said grommet is to be inserted into the through hole, said contact portion is pressed into sealing contact with the hole wall of the through hole.

3. The terminal connecting device according to claim 1, wherein a part of said grommet that fits in the through hole has a diameter larger than an inner diameter of the through hole.

4. The terminal connecting device according to claim 1, wherein a diameter of said grommet is largest at a part of said grommet that fits in the through hole.

5. The terminal connecting device according to claim 1, wherein said grommet includes a hollow portion, further comprising an adhesive injected into the hollow portion.

6. The terminal connection device according to claim 5, wherein the adhesive is a thermosetting adhesive.

7. The terminal according to claim 1, wherein both ends of said bus bar are provided with a flat terminal connection portion.

8. A terminal connecting device for connecting an outer terminal provided outside a casing with an inner terminal provided inside the casing through a conductive bus bar inserted through a circular through hole in a wall surface of said casing, the terminal connecting device comprising:

said bus bar having a circular section, at least one end of said bus bar being provided with a flat terminal connecting portion, a grommet formed of an insulating material, the grommet attached to the circular section and including a hollow portion, and an adhesive injected into the hollow portion, wherein the grommet seals along a hole wall of the through hole by pressure.

9. The terminal connection device according to claim 8, wherein the adhesive is a thermosetting adhesive.

* * * * *